US005669836A

United States Patent [19]

Hill

[11] Patent Number: 5,669,836

[45] Date of Patent: Sep. 23, 1997

[54] ARROW WITH MARKING HEAD

[76] Inventor: Jack O'Neil Hill, 14515 Wunderlich Dr. Apt. #1111, Houston, Tex. 77069

[21] Appl. No.: 659,342

[22] Filed: Jun. 6, 1996

[51] Int. Cl.[6] ..... F42B 6/08

[52] U.S. Cl. ..... 473/574; 473/578

[58] Field of Search ..... 273/416, 418, 273/419, 344, 345, 346, 347; 473/569, 572, 574, 578, 581, 582

[56] References Cited

U.S. PATENT DOCUMENTS

| | | | |
|---|---|---|---|
| 295,304 | 3/1884 | Swan | 273/418 |
| 397,950 | 2/1889 | White | 273/344 |
| 532,770 | 1/1895 | Davids | 273/418 |
| 735,415 | 8/1903 | Schrodel | 273/347 |
| 1,545,476 | 7/1925 | Austerman | 273/416 |
| 3,190,654 | 6/1965 | Ross | 273/418 X |
| 3,528,662 | 9/1970 | Merchant et al. | 273/418 |
| 4,257,589 | 3/1981 | Outlaw | 273/580 X |
| 4,541,402 | 9/1985 | Winters | 273/347 X |
| 5,009,165 | 4/1991 | Morris | 273/418 X |
| 5,035,183 | 7/1991 | Luxton | 273/418 X |

*Primary Examiner*—William H. Grieb
*Attorney, Agent, or Firm*—Harrison & Egbert

[57] ABSTRACT

An arrow including a shaft, a head affixed to the shaft and being formed of an elastomeric material, and a marker receptacle formed at an end of the head opposite the shaft. The marker receptacle serves to receive a marker material and to release the marker material upon contact between the head and a target. The head is a truncated cone having a narrow end attached to the shaft. A cavity is formed in the head opposite to the shaft and opens to the surface of the head opposite the shaft. The marker receptacle is deformable so as to release the marker material. The marker is viscous paint which adheres to the target upon contact with the target.

9 Claims, 2 Drawing Sheets

ARROW WITH MARKING HEAD

TECHNICAL FIELD

The present invention relates to arrows. More particularly, the present invention relates to arrows that are used for target practice or for non-injurious contact with a living target. More particularly, the present invention relates to projectiles which release paint or other materials upon contact with a target.

BACKGROUND ART

Bow hunting is an increasingly popular activity upon many hunters. In bow hunting, the hunter will attempt to shoot the arrow so as to "kill" an animal. In this practice, bows and arrows are used in place of more common weapons, such as guns and rifles.

Unfortunately, bow hunters often wound many deer due to the lack of practice under field conditions. Additionally, many bow hunters do not wish to injure or kill the deer but rather to enjoy the hunting experience by hitting the deer with a non-lethal or non-injurious arrow.

It is possible to use conventional rubber-tipped arrows for the purpose of such "practice" bow hunting. However, such rubber-tipped arrows do not leave a mark on the animal. As such, it is difficult, if not impossible, to accurately determine whether the arrow has successfully contacted the animal. Additionally, it is not possible to determine whether such contact would have resulted in a "kill". As a result, a need has developed so as to allow the bow hunter the opportunity to leave a mark on the animal so that the bow hunter can determine if the arrow has contacted the animal and if the contact was in a desired location.

In the past, various patents have issued relating to marking projectiles. For example, U.S. Pat. No. 1,545,476, issued on Jul. 14, 1925, to A. H. Austerman, U.S. Pat. No. 295,304, issued on Mar. 18, 1884, to G. E. Swan, and U.S. Pat. No. 532,770, issued on Jan. 22, 1895, to J. B. Davids teach various archery missiles that have been equipped so as to leave a mark where the projectile strikes the target. U.S. Pat. No. 1,545,476 includes a marker of colored chalk or talcum powder on the tip of the arrow. U.S. Pat. No. 295,304 teaches a rubber arrow head with a chalk covering. U.S. Pat. No. 532,770 teaches an arrow head which includes a chamber that can be filled with chalk, flour, or a similar substance such that the impact of the arrow head upon the target can cause the material to pass through the end of the arrow head. U.S. Pat. No. 5,035,183, issued on Jan. 30, 1991, to D. Luxton, U.S. Pat. No. 3,528,662, issued on Sep. 15, 1970, to Merchant et al., and U.S. Pat. No. 3,190,654, issued on Jun. 22, 1965, to J. T. Ross teach various projectiles that leave liquid marks when they strike a target. U.S. Pat. No. 5,035,183 teaches a projectile in which a liquid is contained on the interior of a capsule. When the capsule contacts a target surface, it will break open so as to allow the liquid to mark the target. U.S. Pat. No. 3,528,662 describes a projectile having a frangible cartridge which will rupture upon impact. U.S. Pat. No. 3,190,654 also teaches a projectile which includes a frangible capsule that contains a colored fluid.

U.S. Pat. No. 4,541,402, issued on Sep. 17, 1985, to B. J. Winters describes a livestock marker which is designed to adhesively place a tag on the body of an animal.

It is an object of the present invention to provide an arrow which can leave a mark on a target without injury to the target.

It is another object of the present invention to provide an arrow which facilitates the practice of bow hunting.

It is another object of the present invention to provide an arrow which includes a marker which will leave a mark upon contact with the target upon a desired amount of impact pressure.

It is a further object of the present invention to provide an arrow which includes a paint-dispensing head which is reusable.

It is still a further object of the present invention to provide an arrow head which dispenses a marking fluid which is easy to use, relatively inexpensive, and easy to manufacture.

These and other objects and advantages of the present invention will become apparent from a reading of the attached specification and appended claims.

SUMMARY OF THE INVENTION

The present invention is an arrow that comprises a shaft, an elastomeric head affixed to the shaft, and a marker receiving means formed at an end of the head opposite the shaft. The marker receiving means serves to receive a marker material for releasing the marker material upon contact between the head and a target.

The head is formed of a truncated cone having a narrow end attached to the shaft and having the marker receiving means formed in the wide end. The head includes a rigid disk which is affixed to the narrow end of the head, and a rod extending through the rigid disk outwardly of the head. The rod is affixed to the shaft. The rigid disk has a similar diameter as the narrow end of the head. The rod has a threaded portion extending outwardly of the head so as to be threadedly affixed to the shaft.

In the preferred embodiment of the present invention, the marker receiving means is a cavity which is formed in the head opposite to the shaft. The cavity opens to a surface of the head opposite the shaft. A plurality of slots extend radially outwardly of the cavity through the head. The slots assure that the head will open uniformly and that no material will extend between the head and the target. The cavity has a diameter inward of the surface of the head which is greater than a diameter of the cavity opening at the surface of the head. The cavity has a hexagonal configuration. Each of the plurality of slots extends radially outwardly at an intersection of a pair of sides of the hexagonal configuration. The marker receiving means has no hysteresis after contact with the target. In the preferred embodiment of the present invention, the marker is viscous paint which adheres to the target upon contact with the target. The leafs formed between the slots spread outwardly from the center upon contact with the target. This assures that no material resides between the paint and the target.

In an alternative embodiment of the present invention, the marker receiving means is a flat surface which is formed at an end of the head opposite the shaft. The flat surface extends in a plane transverse to the longitudinal axis of the shaft.

A marker is affixed to the flat surface. The marker is made of an adhesive material having a first adhesive surface opposite the head. The adhesive material has a second adhesive surface affixed to the end of the head opposite the shaft. The second adhesive surface has a lesser coefficient of adhesion than the first adhesive surface.

DETAILED DESCRIPTION OF THE INVENTION

Figure 1:
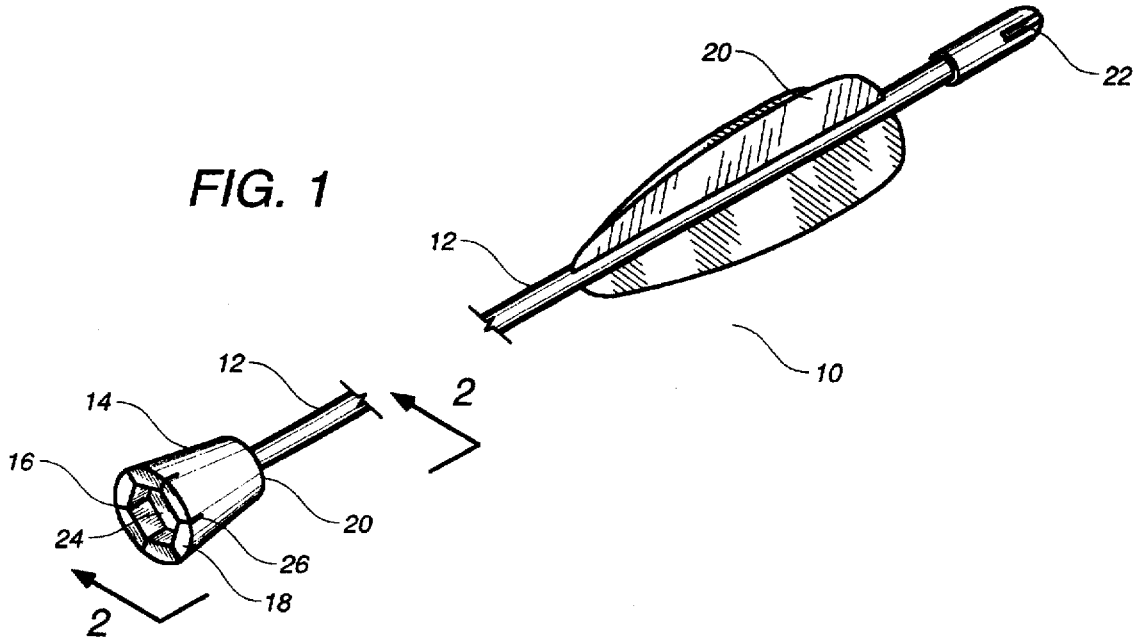
FIG. 1 is a perspective view of the arrow in accordance with the preferred embodiment of the present invention.

Referring to FIG. 1, there is shown at 10 the arrow in accordance with the preferred embodiment of the present invention. The arrow 10 includes a shaft 12, a head 14 affixed to one end of the shaft 12, and a marker receptacle 16 formed at an end of the head 14 opposite to the shaft 12. The marker receptacle 16 serves to receive a marker material and to release the marker material upon contact between the head 14 and a target.

In FIG. 1, the shaft 12 includes fins or feathers 20 which extend outwardly of the shaft 12 in a conventional fashion. A slotted end 22 is provided so as to allow the arrow 10 to be propelled from a bow in a conventional fashion.

The head 14 is formed of an elastomeric material. Preferably, the head 14 and the receptacle 16 are deformable so as to release a marker material from the marker receptacle 16. The elastomeric material which forms the head 14 should be of a suitable material such that no hysteresis occurs after contact between the leaves of the head 14 and the target.

The head 14 is in the form of a truncated cone having a narrow end 20 attached to the shaft 12. The marker receptacle 16 is formed inwardly of the wide leaf end 18 of the head 14.

The marker receptacle 16 includes a cavity 24 which is formed in the head 14 opposite the shaft 12. The cavity 24 opens to the end surface 18 of the head 14. A plurality of slots 26 extend radially outwardly of the cavity 24 through the head 14. The slots 26 allow for the controlled deformation of the surface 14 and the marker receptacle 16. The slots 26 define leaves therebetween. These leaves deform outwardly upon contact with a target so as to assure that the paint has an unobstructed and wide area from which to apply the marker material. As can be seen in FIG. 1, the cavity 24 has a generally hexagonal configuration. In the preferred embodiment of the present invention, the marker receptacle 16 will receive a paste-like paint therein. The paint will adhere to the target upon contact between the surface of the cavity 24 and the target. The paste-like paint should have a viscosity such that it will not vaporize at arrow speeds of greater than 150 miles per hour so as to assure availability upon contact with the target.

Figure 2:
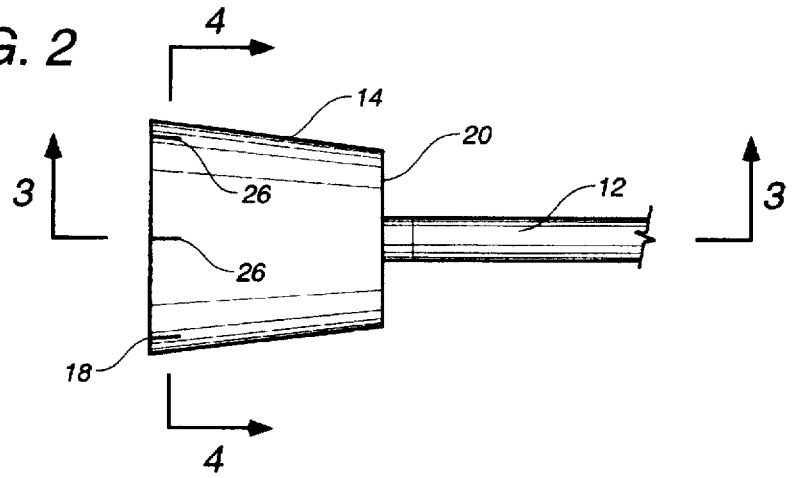
FIG. 2 is a side elevational view of the arrow head in accordance with the preferred embodiment of the present invention.

FIG. 2 shows the head 14 as attached to the shaft 12. It can be seen in FIG. 2 that the head 14 has the configuration of a truncated cone. The narrow end 20 of the truncated cone configuration is connected to the shaft 12. The wide end 18 of the head 14 is opposite the narrow end 20. Slots 26 are formed so as to extend radially outwardly of the cavity 24.

Figure 3:
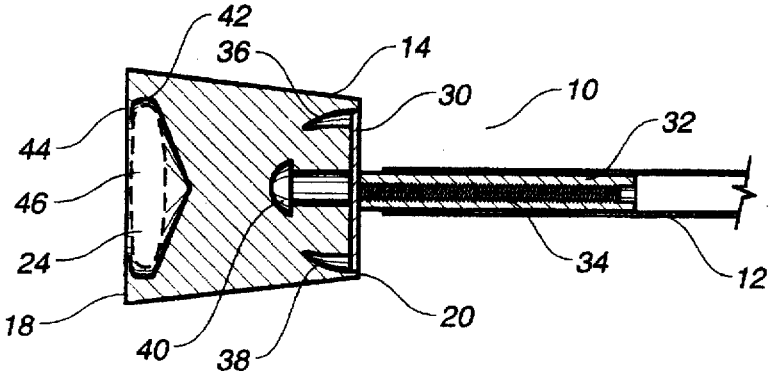
FIG. 3 is a cross-sectional view taken across lines 3—3 of FIG. 2 of the arrow head of the present invention.

FIG. 3 is a cross-sectional view of the arrow 10 of the present invention. Importantly, FIG. 8 shows the manner in which the head 14 is secured to the shaft 12. Initially, it can be seen that a rigid disk 30 is affixed to the narrow end 20 of the head 14. A rod 32 extends through the rigid disk 30 and outwardly of the head 14. This rod 32 is affixed to the shaft 12. The rigid disk 30 has a similar diameter as the narrow end 20 of the head. The rod 32 includes a threaded portion 34 extending outwardly of the head 14. The threaded portion 34 of the rod 32 is threadedly affixed to the shaft 12. The rigid disk 30 is secured to the head 14 by adhesion of the elastomer into the insert protrusions 36 and 38. These insert protrusions 36 and 38 provide increased surface area for the elastomeric material to be bonded to and to counteract any shear forces that the head 14 encounters upon impact with the target. Additionally, a head 40 of the rod 32 is positioned on the interior of the head 14 so as to further secure the engagement between the head 14 and the shaft 12. If it is necessary to replace the head, it can be simply threadedly unscrewed from the shaft 12.

The cavity 24 is formed in the head 14 at the wide leaf end 18 of the truncated cone of the head 14. As can be seen, the cavity 24 has a unique configuration which is suitable for receiving paint (illustrated in broken line fashion) therein. The cavity 24 has a diameter 42 inwardly of the leaf end 18 of the head 14. The diameter 42 of the cavity 24 is greater than the diameter 44 at the area in which the cavity 24 opens at the leaf surface 18. As such, this narrowed opening facilitates the retention of the paint 46 therein. This configuration further enhances the application of the paint 46 in the cavity 24 upon contact with the target. This leaf surface 18 protects the paint from dispersing during arrow flight.

Figure 4:
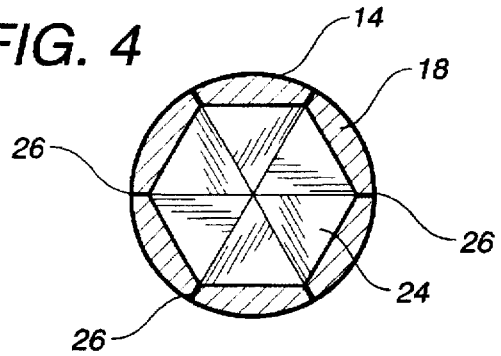
FIG. 4 is a cross-sectional view taken across lines 4—4 of FIG. 2 of the arrow head of the present invention.

FIG. 4 shows the end leaf surface 18 of the head 14. It can be seen that the cavity has a hexagonal configuration. A plurality of slots 26 extend through the head 14 from the cavity 24. Each of the slots 26 extends radially outwardly of the cavity 24 at the area of intersection between adjacent sides of the hexagonal configuration of the cavity 24. The use of the slots 26 greatly facilitates the deformability of the cavity upon contact with a target. The expansion of the leaf end 18 increases the surface area in contact with the target so as to reduce the possibility of damage or injury to the target.

Figure 5:
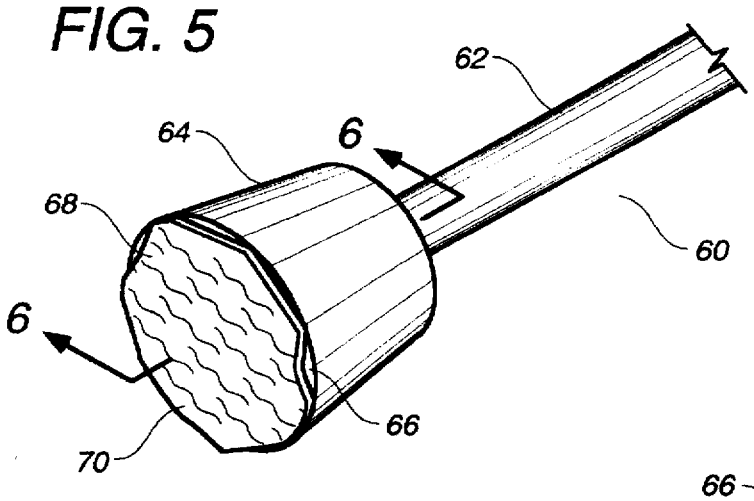
FIG. 5 is a perspective view of an alternative embodiment of the arrow head of the present invention.

FIG. 5 shows an alternative embodiment of the arrow of the present invention. The alternative embodiment 60 includes a shaft 62 and a head 64 connected to one end of the shaft 62. The form of connection between the head 64 and the shaft 62 can be in a manner similar to that shown in FIG. 3.

The important difference in the embodiment 60 of this alternative embodiment is in the configuration of the marker receptacle. The arrow 60 has a flat surface 66 formed at an end of the head 64 opposite the shaft 62. The flat surface 66 is in a plane which is transverse to a longitudinal axis of the shaft. A marker 68 is affixed to the flat surface 66. The marker 68 adhesive material having a first adhesive is an opposite the flat surface 66 of the head 64. In this surface configuration, when the arrow 60 is released from a bow, the marker 64 will adhesively affix to the target upon contact between the flat surface 66 and the target. The adhesive surface 70 serves to assure that the adhesive material 68 will adhere to the target.

Figure 6:
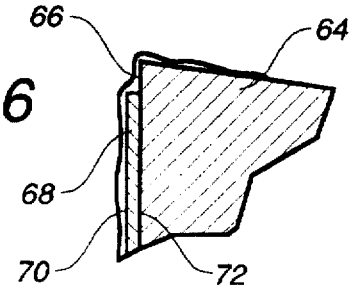
FIG. 6 is a detailed cross-sectional view taken across lines 6—6 of FIG. 5 of the alternative embodiment of the arrow head of the present invention.

FIG. 6 shows that the adhesive material 68 is secured to the flat surface 66 of the head 64. Importantly, a second adhesive surface 72 is formed on the adhesive material 68 opposite the adhesive surface 70. As such, an adhesive is used to secure the marker 68 to the end surface 66. The second adhesive surface 72 has a lesser coefficient of adhesion than the first adhesive surface 70. As such, the marker 68 will release from the surface 66 of the head 64 upon contact with the target. The marker 64 can be multi-sided and/or brightly colored so as to enhance the ability to identify the area of contact between the arrow and the target.

The present invention provides an arrow by which bow hunters can practice under field conditions. The arrow of the present invention will allow a bow hunter to leave a mark showing the impact point of the arrow on the animal so that the hunter can perfect his skill in the field. The impact of the arrow upon a deer will not harm the deer. Practice with the arrow of the present invention can be most beneficial to novice bow hunters.

The elastomeric material which is used for the head is formulated so as to absorb energy at a high rate. It is the same type of rubber material which is used in the construction of fenders to protect offshore oil rigs from ships moored alongside. The cavity that holds the paint has a unique design whereby the cavity is partially closed over the paint while waiting for a shot and during the flight of the arrow. The cavity to retain the paint in a moist and integral mass. The cavity opens upon impact so as to apply the paint to the animal. The cavity closes after impact with no hysteresis.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. An arrow comprising:

a shaft;

a head affixed to the shaft, said head being formed of an elastomeric material, said head being a truncated cone having a narrow end attached to said shaft;

a rigid disk having insert protrusions extending into said elastomeric material of said head, said narrow end of said shaft having a flat surface juxtaposed against said rigid disk;

a rod extending outwardly from a side of said rigid disk opposite said insert protrusions and said head, said rod being threadedly received by said shaft; and a marker receiving means formed at an end of said head opposite said shaft, said marker receiving means for receiving a marker material and for releasing said marker material upon contact between said head and a target.

2. The arrow of claim 1, said rigid disk being of a similar diameter as said narrow end of said head.

3. The arrow of claim 1, said rod having a threaded portion extending outwardly of said head, said rod being threadedly affixed to said shaft.

4. The arrow of claim 1, said marker receiving means comprising:

a cavity formed in said head opposite said shaft, said cavity opening to a surface of said head opposite said shaft.

5. The arrow of claim 4, said marker receiving means further comprising:

a plurality of slots extending radially outwardly of said cavity through said head.

6. The arrow of claim 5, said cavity having a multi-sided configuration, each of said plurality of slots extending radially outwardly at an intersection of a pair of sides of said multi-sided configuration.

7. The arrow of claim 1, said marker being a viscous paint which adheres to the target upon contact with the target.

8. An arrow comprising:

a shaft;

a head affixed to the shaft, said head being formed of an elastomeric material; and a marker receiving means formed at an end of said head opposite said shaft, said marker receiving means for receiving a marker material and for releasing said marker material upon contact between said head and a target, said marker receiving means comprising:

a cavity formed in said head opposite said shaft, said cavity opening to a surface of said head opposite said shaft; and a plurality of slots extending radially outwardly of said cavity through said head, said cavity having a diameter inward of said surface of said head which is greater than a diameter of said cavity opening at said surface of said head.

9. An arrow comprising:

a shaft;

a head affixed to said shaft, said head being formed of an elastomeric material, said head being a truncated cone having a narrow end attached to said shaft; and a marker receiving means formed at a wide end of said head opposite said shaft, said marker receiving means for receiving a marker material and for releasing said marker material upon contact between said head and a target, said marker receiving means comprising:

a cavity formed in said head opposite said shaft, said cavity opening at said wide end of said head, a plurality of slots extending radially outwardly of the cavity through the head, said cavity having a multiple flat sided configuration, each of said plurality of slots extending radially outwardly at an intersection of a pair of adjacent sides of said multiple flat sided configuration, each of said sides forming a leaf which opens upon impact with the target.

* * * * *